US005302789A

United States Patent [19]

Hellman, Sr. et al.

[11] Patent Number: 5,302,789

[45] Date of Patent: Apr. 12, 1994

[54] SNAP SWITCH HAVING LOW RESISTANCE

[75] Inventors: Robert R. Hellman, Sr., Oxford; Stephen B. Barrey, Milford, both of Conn.

[73] Assignee: Westport Development & Manufacturing Company, Inc., Orange, Conn.

[21] Appl. No.: 24,797

[22] Filed: Mar. 1, 1993

Related U.S. Application Data

[63] Continuation-in-part of Ser. No. 856,874, Feb. 24, 1992, abandoned, which is a continuation of Ser. No. 605,880, Oct. 29, 1990, abandoned.

[51] Int. Cl.[5] ..... H01H 5/18

[52] U.S. Cl. ..... 200/461; 200/459; 200/275; 200/243

[58] Field of Search ..... 200/407, 408, 409, 459, 200/460, 461, 273, 278, 275, 276, 253, 241, 242

[56] References Cited

U.S. PATENT DOCUMENTS 2,182,856 12/1939 Riche ..... 200/407 X
2,439,747 4/1948 Nelson ..... 200/456
4,017,699 4/1977 Hellman ..... 200/50 C
4,447,688 5/1984 Schaad et al. ..... 200/531
4,839,483 6/1989 Doyle ..... 200/275 X

FOREIGN PATENT DOCUMENTS 222711 8/1962 Austria ..... 200/243

*Primary Examiner*—Henry J. Recla
*Assistant Examiner*—David J. Walczak
*Attorney, Agent, or Firm*—John H. Crozier

[57] ABSTRACT

In a preferred embodiment, a snap switch which employs a conical contact mounted at the free end of a spring blade. The contact completes an electrical circuit by contacting and electrically joining two, round, spaced apart terminals. The resulting dual radii contact provides high unit pressure and a minimum of polymer-forming wiping action. The switch introduces little resistance into the electrical circuit, since the spring blade carries no current. The terminal wires are of nickel with sleeves of oxidized nickel bonded thereto in the region where the wires pass through the base of the switch. The oxide provides a tenacious surface for the adherence thereto of sealing glass to insulatively bond the wires to the base.

6 Claims, 3 Drawing Sheets

SNAP SWITCH HAVING LOW RESISTANCE

This is a continuation-in-part of co-pending application Ser. No. 07/856,874 filed on Feb. 24, 1992, now abandoned, which is a continuation of co-pending application Ser. No. 07/605,880 filed on Oct. 29, 1990, now abandoned.

BACKGROUND OF THE INVENTION

1Field of the Invention

The present invention relates generally to electrical switches of the snap-action type and, more particularly to a novel snap switch which operates satisfactorily at very low current and voltage levels and which includes a contact which has a self-cleaning action.

2. Background Art

Snap switches are well known devices for switching the flow of electricity and are manufactured, for example by Westport Development & Manufacturing Company, Inc. The type of such switches to which the present invention relates have a one-piece spring blade with a contact carrying free end which is selectively moved between electrical terminals. The blade is of the snap-acting, over center type and has an operation point which, if sufficiently linearly moved beyond a prescribed limit, distorts the blade to effect the snap-action and a subsequent movement of the free contact end from one terminal to another. The movement of the blade is maintained within a range by two spaced apart stop members. The amount of movement of the operation point from one stop member until the blade shifts from one contact to the other is precisely determined and is generally maintained constant throughout a wide range of operating temperatures.

Such type of snap switches is described in U.S. Pat. Nos. 3,278,700; 3,609,269; and 4,017,699, issued to Robert R. Hellman, and assigned to the assignee of the present invention, the disclosures of all of which patents are hereby made a part hereof by reference. The first of the patents describes a snap switch having a bracket for preloading the blade and certain features for temperature compensation. The second of the patents describes such a switch disposed in a hermetically sealed housing and actuatable by means of the distortion of a sidewall of a tube forming part of the housing. The third of the patents describes a snap switch employing two snap switches mounted together so that both are actuated simultaneously.

While the switches described above have provided satisfactory service, they are somewhat limited in that there are lower limits of voltage and current below which they cannot be used, due to fouling of the flat surfaces contacted by the round contact ball at the free end of the blade. This fouling is due, in part, to the creation of polymer from ambient impurities by the contact ball as it only slightly wipes the surfaces. This slight wiping action is insufficient to clean the polymer thus formed from the surfaces. In addition, when the contact ball contacts a spherical surface on a terminal, there is a flattening of the contacting surfaces because of the wiping action. The lower limits of known such switches are about 10 milliamperes and 10 volts.

Another factor contributing to the limitations of the prior snap switches is that the blade itself is in the electrical circuit between two terminals, since the fixed end of the blade is mounted on a common terminal. This introduces additional resistance into the total circuit, since desirable spring materials are relatively poor electrical conductors. The lowest total switch resistance obtained with conventional switches has been on the order of about 60–80 milli-Ohms.

Furthermore, it is desirable that the current carrying components of such switches have the most efficient electrical characteristics, but that these be combined with lower cost materials for other components requiring other characteristics such as weldability and suitability for high temperature service.

Accordingly, it is an object of the present invention to provide a snap switch that is capable of use at lower voltage and current levels than previously known such switches.

An additional object of the invention is to provide such a switch that employs a self-cleaning contact.

Another object of the invention is to provide such a switch in which the blade thereof does not become part of the electrical circuit being switched.

A further object of the invention is to provide such a switch which is usable at higher temperatures than previously known such switches.

Yet an additional object of the invention is to provide such a switch that may be economically constructed.

Yet another object of the invention is to provide such a switch which has lower total electrical resistance than previously known such switches.

Other objects of the present invention, as well as particular features and advantages thereof, will be elucidated in, or be apparent from, the following description and the accompanying drawing figures.

SUMMARY OF THE INVENTION

The present invention achieves the above objects, among others, by providing, in a preferred embodiment, a snap switch which employs a conical contact mounted at the free end of a spring blade. The contact completes an electrical circuit by contacting and electrically joining two, round, spaced apart terminals. The resulting dual radii contact provides high unit pressure and a minimum of polymer-forming wiping action. The switch introduces little resistance into the electrical circuit, since the spring blade carries no current. The terminal wires are of nickel with sleeves of oxidized nickel bonded thereto in the region where the wires pass through the base of the switch. The oxide provides a tenacious surface for the adherence thereto of sealing glass to insulatively bond the wires to the base.

BRIEF DESCRIPTION OF THE DRAWING

Understanding of the present invention and the various aspects thereof will be facilitated by reference to the accompanying drawing figures, in which.

DETAILED DESCRIPTION OF THE PREFERRED EMBODIMENTS

Figure 1:
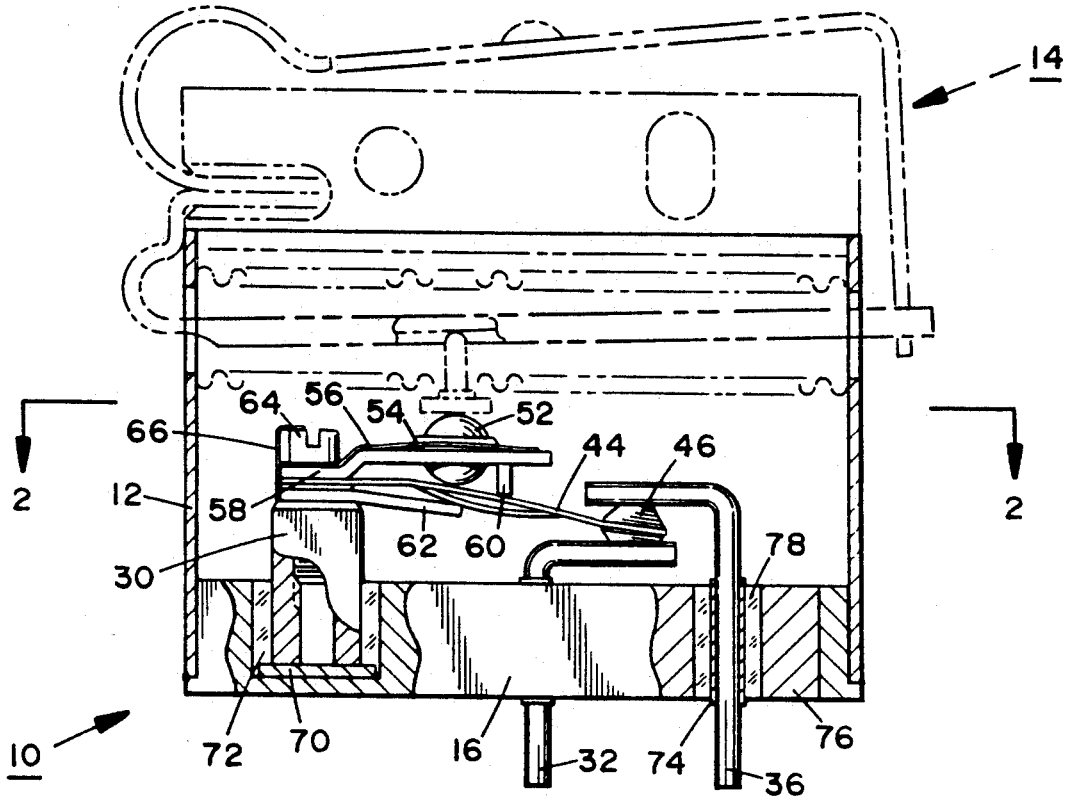
FIG. 1 is an enlarged, side elevational view, partially cut-away and partially in cross-section, of a snap switch according to the present invention.
Figure 2:
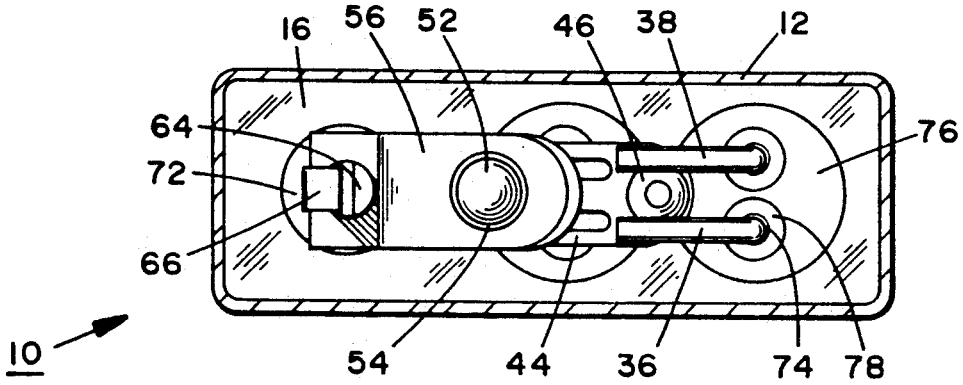
FIG. 2 is an enlarged, top plan view, partially in cross-section, taken along line "2—2" of FIG. 1.

Referring now to the Drawing, in which like elements are given consistent identifying numerals through the various figures thereof, there is shown a snap switch constructed according to the present invention, generally indicated by the reference numeral 10.

Switch 10 may be hermetically sealed in a housing 12 at the upper end of which is an actuator mechanism, generally indicated by the reference numeral 14, which may be of the type described in U.S. Pat. No. 3,609,269. Housing 12 is welded to a base 16 of Type 321 or 347 stainless steel. It will be understood that the present invention may also be embodied in an unsealed switch.

Switch 10 includes an internally threaded metallic support post 30, a first pair of nickel electrical terminals 32 and 34, and a second pair of nickel electrical terminals 36 and 38, all insulatively mounted to base 16. A spring blade 44 has one end fixedly attached to support post 30 and the other end free. Attached to the free end of spring blade 44 is a double conical contact 46 which is movable between contacting engagement with first pair of terminals 32 and 34 and contacting engagement with second pair of terminals 36 and 38. A corundum ball 52, for insulation and motion transfer, is fixedly mounted with an anti-rotation ball retainer 54 to the free end of a flat spring 56 the other end of which is fixedly mounted to support post 30. Also fixedly mounted to support post 30 are an upper stop 58 having thereon a downward facing tang 60 to preload spring blade 44 and to limit the upper movement thereof and a lower stop 62 to limit the downward movement of the spring blade. While the elements fixedly attached to support post 30 are shown as be attached with a threaded screw 64 and a welded strap 66, any suitable means of attachment may be employed.

Reference now to FIG. 1 will aid in understanding how support post 30 and terminal pairs 32/34 and 36/38 are mounted to base 16. Below support post 30 is an insulating corundum pad 70 which together with the support post is held in place in base 16 by means of fused sealing glass 72. Terminal 36 has braised thereto a tubular Inconel 750 sleeve 74 which is secured to an Inconel 750 slug 76 by means of fused sealing glass 78. Slug 76 is welded to base 16. Such a composite arrangement provides a high integrity glass-to-metal seal for use at high temperatures—up to 1000 degrees Fahrenheit. Terminals 32, 34, and 38 are similarly attached to base 16. Alternatively, terminals 32, 34, 36, and 38 may be disposed in separate slugs.

Nickel is the preferred material for terminals 32, 34, 36, and 38, since it is an excellent electrical conductor at high temperatures. Inconel 750 is the preferred choice for sleeve 74 and slug 76, since, when it is pre-oxidized, it has a tenacious oxide film to which sealing glass adheres exceptionally well. Slug 76 is provided so that only a small part of base 16 needs to be made of the relatively expensive material. Base 16 could be constructed entirely of Inconel 750, but the cost would be greater and Inconel 750 is difficult to weld, for example, to attach housing 12 thereto. The techniques for constructing and assembling the elements of switch 10 are well known in the art.

In use, corundum ball 52 transfers motion from actuator 14 so that contact 46 in the free end of spring blade 44 selectively contactingly engages either first terminal pair 32/34 or second terminal pair 34/36, with downward motion of the actuator causing contact with second terminal pair 34/36 and upward motion of the actuator causing contact with first terminal pair 32/34. The mechanism of such movement is described in the above-referenced patents.

Figure 3:
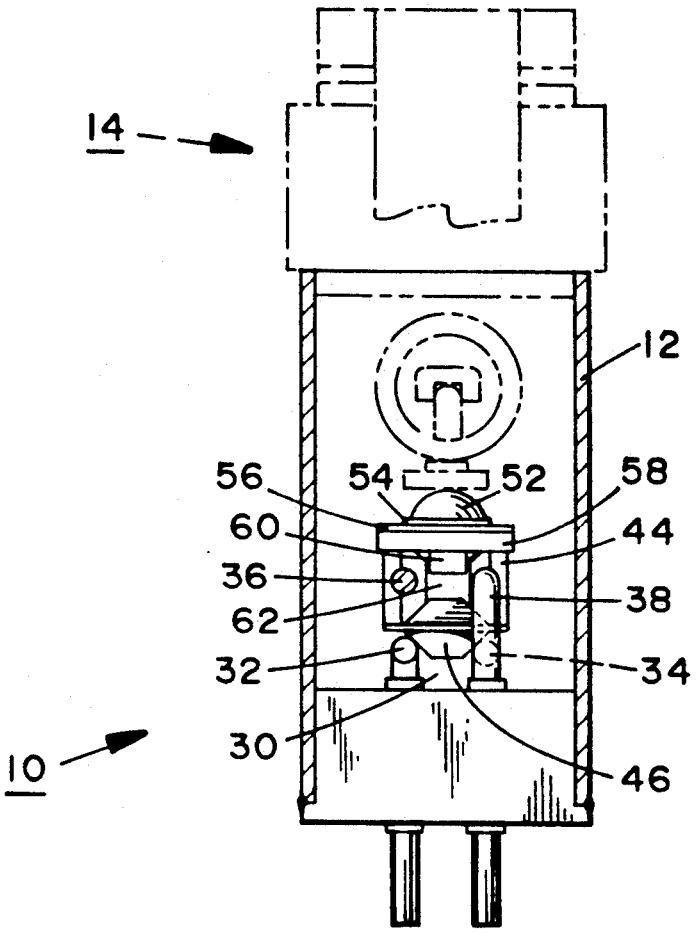
FIG. 3 is an enlarged, front elevational view, partially cut-away and partially in cross-section, of the snap switch of FIG. 1.

As best seen on FIG. 3, contact 46 engages first terminal pair 32/34 such that the conical surface of the contact is in engagement with the cylindrical surface of the terminals so that there is a dual radii contact. This provides essentially a point contact with a high unit pressure which breaks any film formed on the contacting surfaces. It has been found that such engagement of (and the subsequent disengagement from) both terminal pairs 32/34 and 36/38 is rapid and simultaneous. It has been found, further, that contact 46 provides self-cleaning, due to the high unit pressure at the contact point and due to the high degree of wiping action afforded by the spreading apart of terminal pairs 32/34 and 36/38 by the wedging action of conical contact 46. This degree of wiping action is impossible to achieve with a spherical contact, since the radius of the sphere changes too abruptly with respect to the position of the terminal pairs.

With no contact blade in the circuit and with the materials of construction as noted above, it has been found that the total electrical resistance of switch 10 is on the order of about 10–14 milli-Ohms. The low resistance of the point of engagement of contact 46 with a pair of terminals is indicated by the fact that the resistance of a pair of terminals themselves is about 8 milli-Ohms. It has been found that switch 10 provides satisfactory performance at a current level of 1 milliampere at 5 volts.

Figure 4:
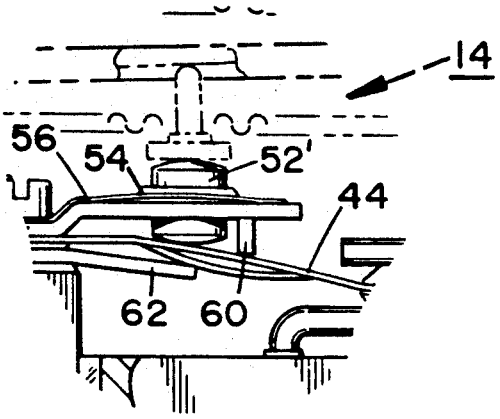
FIG. 4 is an enlarged, fragmentary, side elevational view of an alternative embodiment of the snap switch of the present invention.

FIG. 4 illustrates an alternative embodiment of the present invention. While corundum ball 52 is entirely satisfactory in many such snap switches, it has been found that when the snap switches are operated in very high vibration environments, the ball rotates slowly, the surface of the ball metallizes, and the ball then provides a electrically conductive path between spring blade 44 and actuator 14. In the embodiment of snap switch 10 shown on FIG. 4, corundum ball 52 has been replaced with a corundum cylinder 52' having convex ends which contact actuator 14 and spring blade 44. Corundum cylinder 52' cannot rotate top to bottom and, therefore, even though the upper and lower surfaces of the cylinder may metallize, no conductive path will be formed therebetween.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A snap switch, comprising:

(a) a base member;

(b) a support post attached to said base member;

(c) a snap-action, over center spring blade having a proximal end attached to said support post and a distal end free;

(d) actuator means operatively engaging said spring blade to cause said spring blade to selectively snap between first and second positions;

(e) said free end of said spring blade having attached thereto a contact having a first conical contact surface extending outwardly from a first surface of said spring blade, said contact being moveable generally vertically as said spring blade snaps between said first and second positions; and (f) a first pair of spaced apart terminals attached to said base, said terminals comprising two, generally horizontal, parallel, round wires, and disposed such that when said spring blade is snapped to its first position, said first contact surface will engage both of said first pair of terminals to complete an electrical circuit from one of said first pair of terminals, through said contact, and to the other of said first pair of terminals, said engagement being such that the radius of said first conical contact surface engages the radii of said first pair of terminals.

2. A snap switch, as defined in claim 1, further comprising:

(g) said contact having a second conical contact surface extending outwardly from a second surface of said spring blade opposite said first surface; and (h) a second pair of spaced apart terminals attached to said base, said terminals comprising two, generally horizontal, parallel, round wires, and disposed such that when said spring blade is snapped to its second position, said second contact surface will engage both of said second pair of terminals to complete an electrical circuit from one of said second pair of terminals, through said contact, and to the other of said second pair of terminals, said engagement being such that the radius of said second conical contact surface engages the radii of said second pair of terminals.

3. A snap switch, as defined in claim 2, wherein said engagement of said second conical contact surface with said second pair of terminals causes said second pair of terminals to be wedged apart, thus creating a high degree of wiping action between said second conical contact surface and said second pair of terminals.

4. A snap switch, as defined in claim 1, further comprising an insulating member disposed between said spring blade and said actuator means, said insulating member being of generally cylindrical shape and having first and second convex ends, said first convex end being in contact with said spring blade and said second convex end being in contact with said actuator means.

5. A snap switch, as defined in claim 4, wherein said insulating member is corundum.

6. A snap switch, as defined in claim 1, wherein said engagement of said first conical contact surface with said first pair of terminals causes said first pair of terminals to be wedged apart, thus creating a high degree of wiping action between said first conical contact surface and said first pair of terminals.

* * * * *